US007083450B1

(12) United States Patent
Hughes

(10) Patent No.: US 7,083,450 B1
(45) Date of Patent: Aug. 1, 2006

(54) ELECTRICAL CONNECTOR THAT INHIBITS FLASHOVER

(75) Inventor: David Charles Hughes, Rubicon, WI (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 11/146,121

(22) Filed: Jun. 7, 2005

(51) Int. Cl.
*H01R 13/53* (2006.01)

(52) U.S. Cl. ..... 439/181

(58) Field of Classification Search ..... 439/181–187, 439/921, 190, 201
See application file for complete search history.

(56) References Cited

U.S. PATENT DOCUMENTS

| | | | | |
|---|---|---|---|---|
| 5,221,220 | A * | 6/1993 | Roscizewski | 439/843 |
| 5,277,605 | A * | 1/1994 | Roscizewski et al. | 439/184 |
| 5,393,240 | A * | 2/1995 | Makal et al. | 439/187 |
| 5,445,533 | A * | 8/1995 | Roscizewski et al. | 439/184 |
| 5,525,069 | A * | 6/1996 | Roscizewski et al. | 439/184 |
| 5,655,921 | A | 8/1997 | Makal et al. | |
| 5,766,030 | A * | 6/1998 | Suzuki | 439/282 |
| 5,846,093 | A * | 12/1998 | Muench et al. | 439/89 |
| 5,857,862 | A * | 1/1999 | Muench et al. | 439/181 |
| 5,957,712 | A * | 9/1999 | Stepniak | 439/187 |
| 6,168,447 | B1 * | 1/2001 | Stepniak et al. | 439/187 |
| 6,213,799 | B1 * | 4/2001 | Jazowski et al. | 439/181 |
| 6,416,338 | B1 * | 7/2002 | Berlovan | 439/187 |
| 6,504,103 | B1 | 1/2003 | Meyer et al. | |
| 6,517,366 | B1 * | 2/2003 | Bertini et al. | 439/190 |
| 6,585,531 | B1 * | 7/2003 | Stepniak et al. | 439/187 |
| 6,790,063 | B1 * | 9/2004 | Jazowski et al. | 439/181 |
| 6,796,820 | B1 * | 9/2004 | Jazowski et al. | 439/181 |
| 6,811,418 | B1 * | 11/2004 | Jazowski et al. | 439/181 |
| 6,843,685 | B1 * | 1/2005 | Borgstrom et al. | 439/606 |
| 6,905,356 | B1 * | 6/2005 | Jazowski et al. | 439/181 |
| 6,939,151 | B1 * | 9/2005 | Borgstrom et al. | 439/187 |
| 2002/0055290 | A1 * | 5/2002 | Jazowski et al. | 439/187 |
| 2003/0228779 | A1 * | 12/2003 | Jazowski et al. | 439/181 |
| 2005/0208808 | A1 * | 9/2005 | Jazowski et al. | 439/181 |
| 2005/0260876 | A1 * | 11/2005 | Krause et al. | 439/181 |

OTHER PUBLICATIONS

Loadbreak Apparatus Connectors, "200 A 25 kV Class Loadbreak Bushing Insert," Service Information 500-26, Cooper Power Systems, May 2003, pp. 1-2.

(Continued)

*Primary Examiner*—Ross Gushi
(74) *Attorney, Agent, or Firm*—Fish & Richardson P.C.

(57) ABSTRACT

A first electrical connector is configured to be removably coupled to a second electrical connector that includes a housing and a sleeve that depends from the housing. The first electrical connector includes a body having a longitudinal axis, an interface portion, and a circumferential groove formed in the interference portion. The groove is defined by a circumferential wall of the interference portion. A radial wall extends from the circumferential wall away from the longitudinal axis, and a circumferential extension extends axially from the radial wall. The radial wall and the circumferential extension are configured such that when the first electrical connector is coupled to the second electrical connector, the circumferential extension is snugly received in the sleeve of the second connector to form an air-tight chamber between the sleeve and the interference portion. As the first electrical connector is removed from the second electrical connector, an air flow path is defined around an end of the sleeve in a space between the circumferential extension and the sleeve to allow air to enter the chamber to inhibit flashover.

47 Claims, 5 Drawing Sheets

OTHER PUBLICATIONS

Loadbreak Apparatus Connectors, "200 A kV Class Cooper Posi-Break™ Expanded Range Loadbreak Elbow Connector," Service Information 500-29, Cooper Power Systems, Jan. 2004, pp. 1-4.

Product Brief, "Latched Elbow Indicator," Cooper Power Systems, Bulletin 94014, Apr. 1994, 1 total page.

Kevin Fox, "The Cooper Posi-Break™ Solution to Separable Connector Switching Problems at Wisconsin Electric Power Company," Component Products, Bulletin No. 98065, copyright 1998 Cooper Power Systems, MI 10/98 5M, 2 total pages.

"The Cooper Posi-Break™, Elbow and Cap, Engineered Solution Increases Strike Distance and Improves Reliability," copyright 1998 Cooper Power Systems, Inc., Bulletin 98014, MI 398/15M, 6 total pages.

* cited by examiner

ELECTRICAL CONNECTOR THAT INHIBITS FLASHOVER

TECHNICAL FIELD

This invention relates to electrical connectors.

BACKGROUND

Electrical connectors can be used to connect electrical equipment, such as transformers, to high-voltage power distribution networks. It is often necessary to connect and disconnect electrical connectors during maintenance operations. During disconnection of these electrical connectors, an arc from the energized connector may extend rapidly to the nearby ground, endangering the life of a human operator and causing damage to the equipment. This sudden creation of an arc is known as a "flashover." There is a higher risk of a flashover when separation of connectors causes a partial vacuum to surround the energized component of the connector assembly, since such a partial vacuum decreases the dielectric strength of air surrounding the energized component.

SUMMARY

According to one aspect, a first electrical connector is configured to be removably coupled to a second electrical connector that includes a housing and a sleeve that depends from the housing. The first electrical connector includes a body having a longitudinal axis and an interference portion. A circumferential groove is formed in the interference portion. The groove is defined by a circumferential wall of the interference portion. A radial wall extends from the circumferential wall away from the longitudinal axis, and a circumferential extension extends axially from the radial wall. The radial wall and the circumferential extension are configured such that when the first electrical connector is coupled to the second electrical connector, the circumferential extension is snugly received in the sleeve of the second connector to form an air-tight chamber between the sleeve and the interference portion. As the first electrical connector is removed from the second electrical connector, an air flow path is defined around an end of the sleeve in a space between the circumferential extension and the sleeve to allow air to enter the chamber to inhibit flashover.

Implementations of this aspect may include one or more of the following features. For example, the sleeve may be configured to buckle towards the circumferential wall or into the chamber as the first electrical connector is removed from the second electrical connector. In addition, the chamber may have a relatively large volume, for example approximately 0.7 cubic inches. Furthermore, the first electrical connector may include an indicator configured to indicate when the first electrical connector is incompletely coupled to the second electrical connector. The indicator may include a visible space between an end of the sleeve and the circumferential extension. In addition, the indicator may include a colored region or indicia on the circumferential wall or the radial wall.

According to another aspect, a method of inhibiting flashover in an electrical connector assembly is described. A first electrical connector is provided that includes a body having a longitudinal axis and an interference portion. A circumferential groove is formed in the interference portion. The groove is defined by a circumferential wall of the interference portion. A radial wall extends from the circumferential wall away from the longitudinal axis, and a circumferential extension extends axially from the radial wall. The first electrical connector is coupled to a second electrical connector that has a housing and a sleeve depending from the housing, such that the circumferential extension is snugly received in the sleeve of the second connector to form an air-tight chamber between the sleeve and the interference portion. As the first electrical connector is removed from the second electrical connector, an air flow path is defined around an end of the sleeve in a space between the circumferential extension and the sleeve to allow air to enter the chamber to inhibit flashover.

Implementations of this aspect may include one or more of the following features. For example, the sleeve may be configured to buckle towards the circumferential wall or into the chamber as the first electrical connector is removed from the second electrical connector. In addition, the chamber may have a relatively large volume, for example approximately 0.7 cubic inches. Furthermore, the first electrical connector may include an indicator configured to indicate when the first electrical connector is incompletely coupled to the second electrical connector. The indicator may include a visible space between an end of the sleeve and the circumferential extension. In addition, the indicator may include a colored region or indicia on the circumferential wall or the radial wall. The first connector may include a conical projection extending from the body for being received in a conical bore in the second electrical connector. The conical projection may define an interior bore in the conical projection for receiving a conductive probe of the first connector.

According to another aspect, an electrical connector assembly includes a first electrical connector and a second electrical connector. The first electrical connector includes a body having a longitudinal axis and an interference portion. The second electrical connector includes a housing and a sleeve depending from the housing. A circumferential groove is formed in the interference portion. The groove is defined by a circumferential wall of the interference portion. A radial wall extends from the circumferential wall away from the longitudinal axis, and a circumferential extension extends axially from the radial wall. The radial wall and the circumferential extension are configured such that when the first electrical connector is coupled to the second electrical connector, the circumferential extension is snugly received in the sleeve of the second connector to form an air-tight chamber between the sleeve and the interference portion. As the first electrical connector is removed from the second electrical connector, an air flow path is defined around an end of the sleeve in a space between the circumferential extension and the sleeve to allow air to enter the chamber to inhibit flashover.

Implementations of this aspect may include one or more of the following features. For example, the sleeve of the second connector may be composed of an elastomeric material. The sleeve may be configured to buckle towards the circumferential wall or into the chamber as the first electrical connector is removed from the second electrical connector. In addition, the chamber may have a relatively large volume, for example approximately 0.7 cubic inches. Furthermore, the first electrical connector may include an indicator configured to indicate when the first electrical connector is incompletely coupled to the second electrical connector. The indicator may include a visible space between an end of the sleeve and the circumferential extension. In addition, the indicator may include a colored region or indicia on the circumferential wall or the radial wall.

The details of one or more implementations are set forth in the accompanying drawings and the description below. Other features will be apparent from the description and drawings, and from the claims.

DETAILED DESCRIPTION

Figure 1:
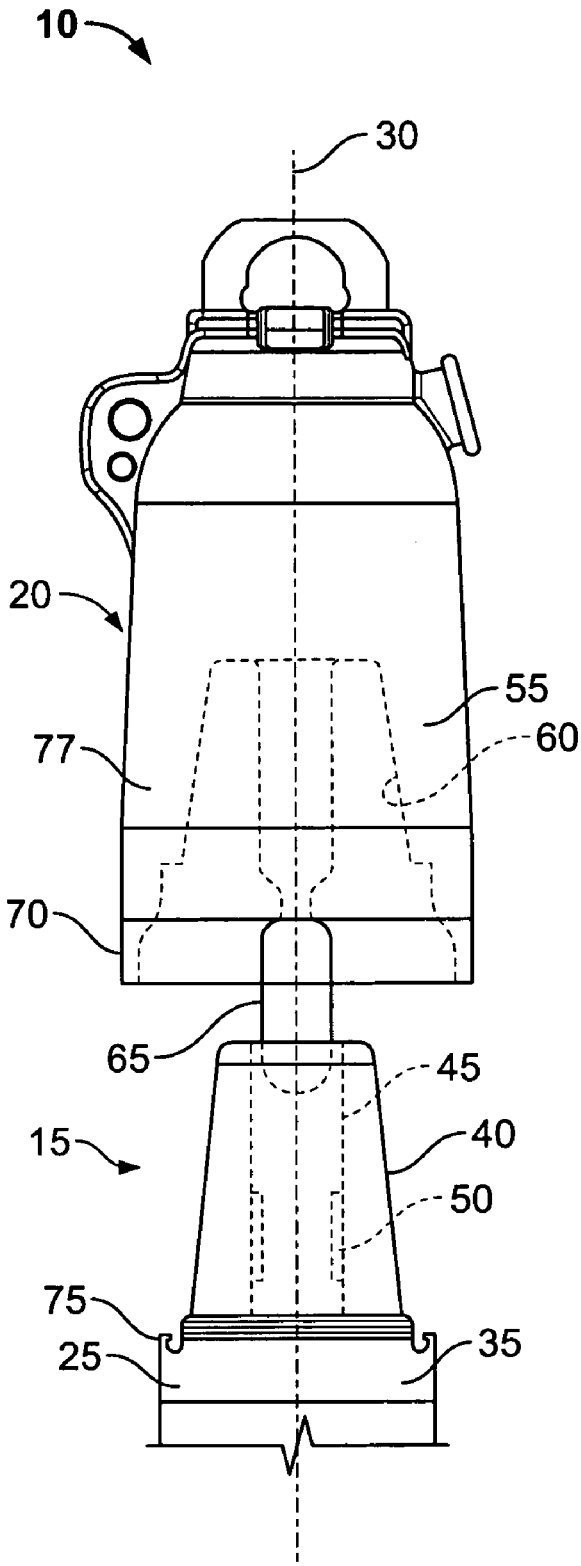
FIG. 1 is a side view of components of an electrical connector assembly in a separated state.
Figure 2:
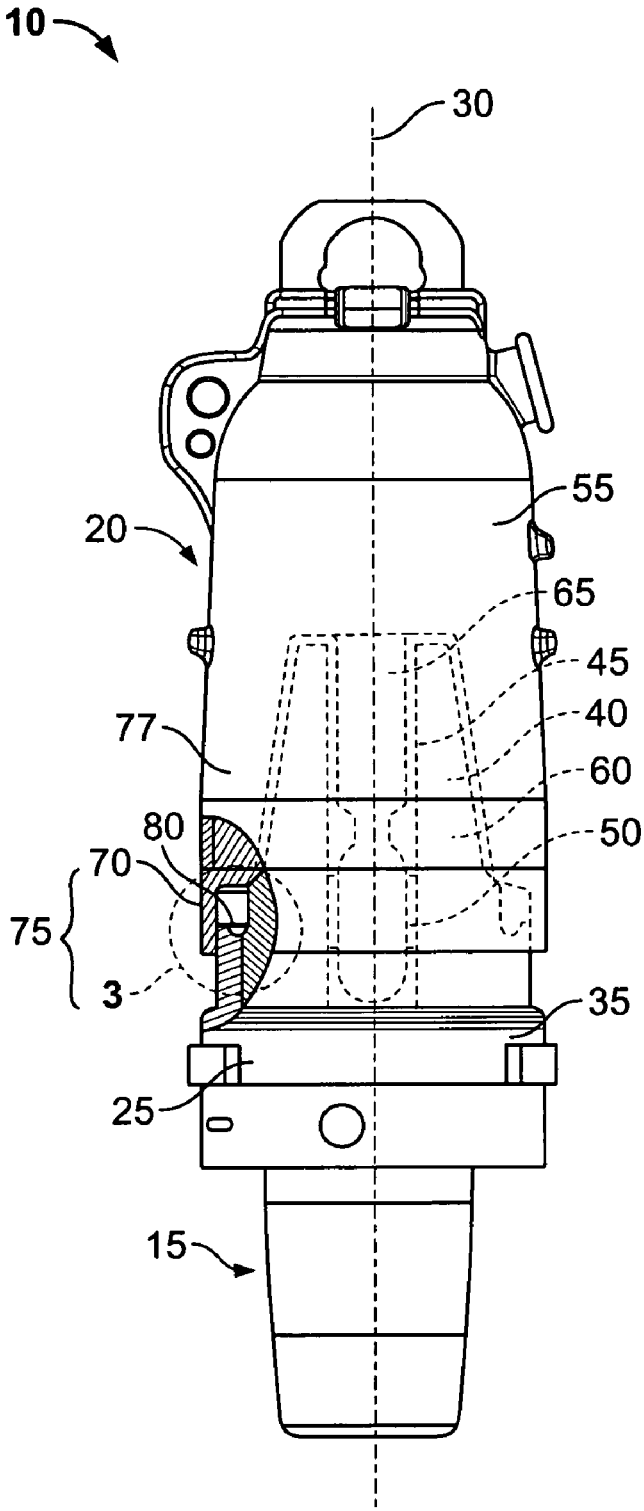
FIG. 2 is a partial cross-sectional view of the electrical connector assembly of FIG. 1 in a connected state.

Referring to FIGS. 1 and 2, in one implementation, an electrical connector assembly 10 includes a first electrical connector 15 connected to a first piece of electrical equipment (not shown) that may be removably coupled to a second electrical connector 20 connected to another piece of electrical equipment (not shown). The first connector 15 includes a body portion 25 defining a longitudinal axis 30. Body portion 25 includes an electrically insulative bushing 35 and an insulative, elastomeric conical projection 40 that extends from bushing 35. Defined in body portion 25 is an interior bore 45 that receives a female conductive contact in the form of a cylindrical conductive sleeve 50.

The second electrical connector assembly 20 includes an elastomeric insulative housing 55 that defines a conical opening 60. Disposed within the conical opening 60 is a male conductive contact in the form of a probe 65. When first and second electrical connectors 15 and 20 are coupled, male conductive probe 65 is received inside female conductive sleeve 50 to make an electrical connection, while conical projection 40 is received inside conical opening 60. Extending from an end 77 of second connector 20 is an elastomeric sleeve 70 that interfaces with an interface portion 75 of first connector 15 when first connector 15 and second connector 20 are coupled.

Figure 3:
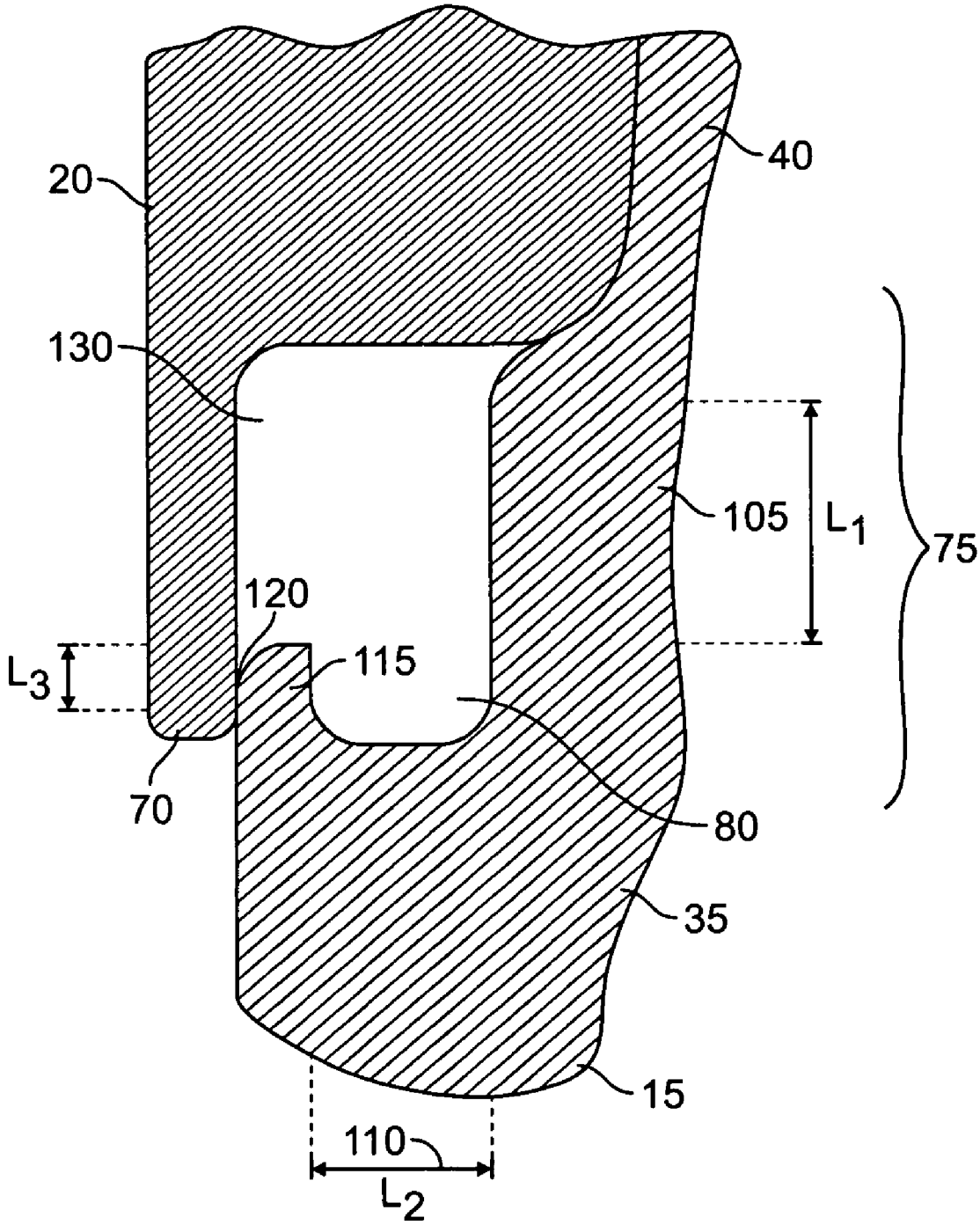
FIG. 3 is a detailed cross-sectional view of the electric connector assembly of FIG. 2 showing an interference portion of the first electrical connector of FIG. 3 coupled with a sleeve of a second electrical connector.

Referring also to FIG. 3, interface portion 75 of first connector 15 includes a J-shaped circumferential groove 80 defined by a circumferential wall 105 of interface portion 75, a radial wall 110 that extends from circumferential wall 105 away from longitudinal axis 30, and a circumferential extension 115 extending axially from the radial wall 110. In one implementation, circumferential wall 105 has a length L1, of approximately 0.35 to 0.45 inches, radial wall 110 has a length L2 of approximately 0.2 to 0.3 inches, and circumferential extension has a length L3 of approximately 0.08 to 0.12 inches.

When second electrical connector 20 is coupled to first electrical connector 15, the circumferential extension 115 is snugly received in elastomeric sleeve 70 of second connector 20 to form an air-tight connection 120 between sleeve 70 and circumferential extension 115. The connection 120 serves to protect the connection between first and second connectors 15 and 20 from moisture and dust. When coupled, elastomeric sleeve 70 and interference portion 75 define an air-tight chamber 130. Using the values of L1, L2, and L3 provided above, and further assuming that the circumferential wall has a diameter of approximately 2.6 inches, the chamber 130 has a relatively large volume on the order of approximately 0.7 cubic inches.

Figure 4:
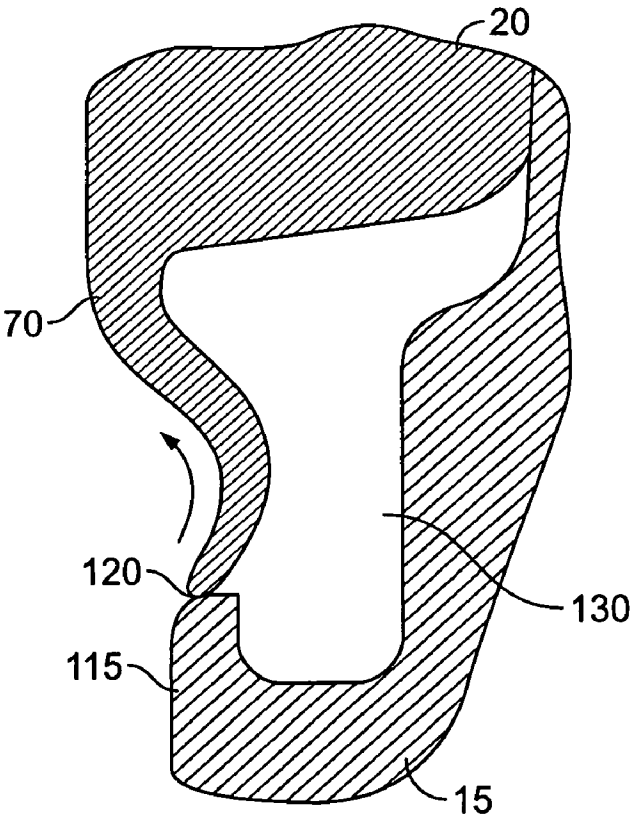
FIG. 4 is a detailed cross-sectional view of the interference portion of a first electrical connector of FIG. 3 partially de-coupled from the sleeve of the second electrical connector.

Referring to FIG. 4, as second electrical connector 20 is separated from first electrical connector 15, the air-tight connection 120 is maintained between sleeve 70 and circumferential extension 115. The volume of chamber 130 increases, reducing the pressure within the chamber 130, which causes sleeve 70 to buckle towards the interior of the chamber 130. The relatively large volume of air-tight chamber 130 prior to separation of the connectors reduces the extent of the pressure drop that results as separation of the connectors begins, and, as a result, decreases the risk of a flashover. The pressure drop and the associated flashover risk are further reduced by buckling of the sleeve 70.

Figure 5:
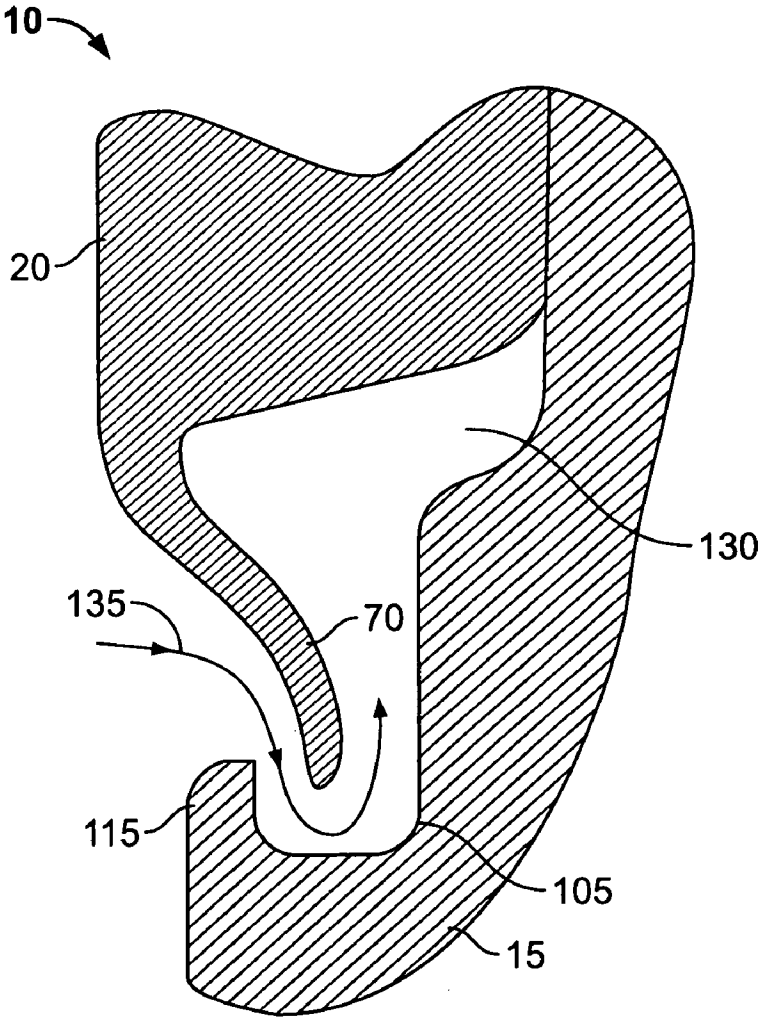
FIG. 5 is a detailed cross-sectional view of showing the interference portion of the first electrical connector of FIG. 3 further de-coupled from the sleeve of the second electrical connector.
Figure 7:
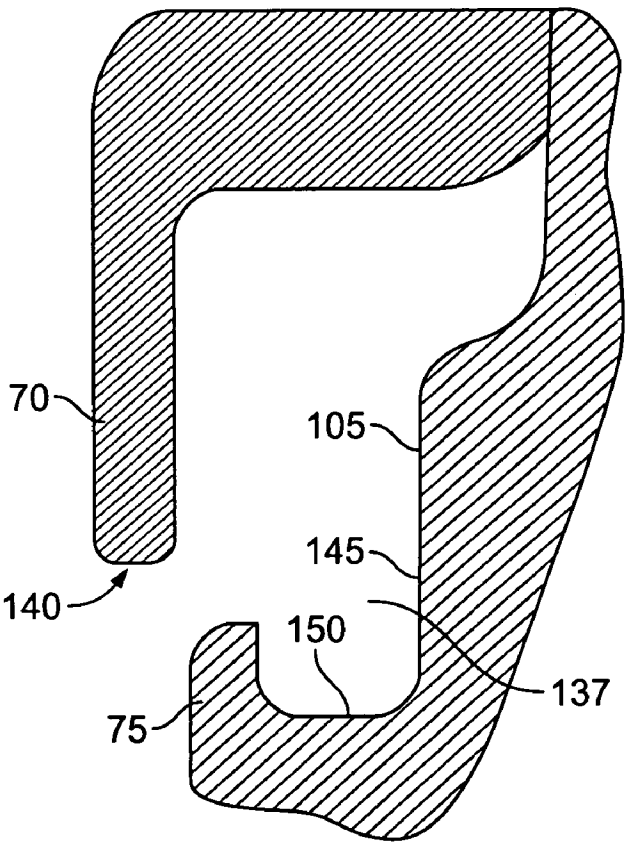
FIG. 7 is a detailed cross-sectional view of the electrical connector of FIG. 1 showing an indicator that indicates the coupling of the first and the second electrical connectors.
Figure 6:
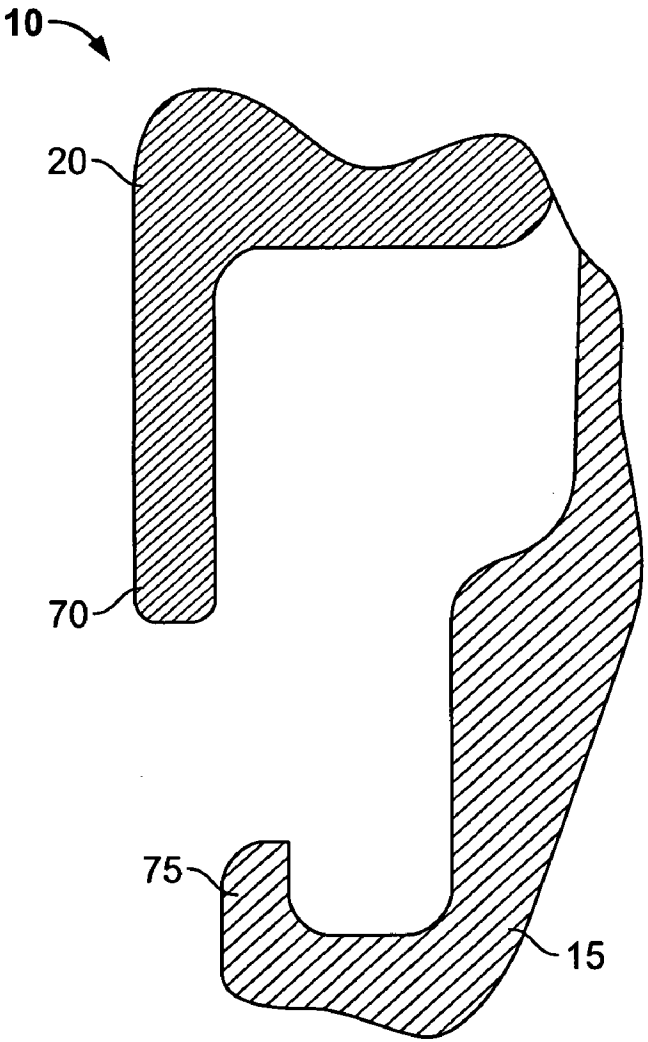
FIG. 6 is a detailed cross-sectional view showing the interference portion of the first electrical connector of FIG. 3 fully de-coupled from the sleeve of the second electrical connector.

Referring to FIG. 5, to further reduce the risk of flashover, sleeve 70 snaps away from circumferential extension 115 as second connector 20 is further removed from first connector 15, which allows air to enter chamber 130 by an air flow path 135 defined around an end of sleeve 70 in the space between extension 115 and radial wall 105. When the air enters chamber 130 along air flow path 135, any partial vacuum is relieved, which reduces the risk of a flashover. Referring to FIG. 6, as second electrical connector 20 is completely removed from first electrical connector 15, sleeve 70 of second connector 20 rebounds to its original shape, which facilitates later use of sleeve 70 in coupling second connector 20 and first connector 15. Referring to FIG. 7, for safety, an indicator 137 indicates when first and second connectors 15 and 20 are not completely coupled. For example, a space 140 defined between elastomeric sleeve 70 and circumferential extension 115 indicates to a user that first and second connectors 15 and 20 are not fully coupled. In addition, circumferential wall 105 may include a colored region 145, or an exterior region 150 of radial wall 110 may be colored. The region may be colored, for example bright yellow, or may be marked with indicia, to indicate the uncoupled condition to the user. For example, if the user sees a bright yellow spot through space 140, the user will know that he has not fully latched first connector 15 and second connector 20 in electrical connector assembly 10.

Particular implementations of the interface portion, including the circumferential groove, the radial extension, and the circumferential extension, create a chamber having a relatively large volume, which reduces the extent of pressure drop as the connectors are separated, and thereby reduces the risk of flashover. The configuration of the circumferential extension, which causes the sleeve to buckle into the chamber as the connectors are being separated, and thereby reduces the pressure drop in the chamber and allows air to enter the chamber more quickly, further reduces the risk of flashover. One or more of these features may be advantageous with respect to prior approaches that included a chamber with a relatively small volume and relied on a venting structure to allow air to enter the cavity so as to reduce the pressure drop and the risk of flashover.

A number of implementations have been described. Nevertheless, it will be understood that various modifications may be made. For example, the first and second electrical connectors may have different shapes, such as elbow shapes, T-shapes, S-shapes, or C-shapes. Additionally, the groove, the sleeve, and the circumferential extension may have rounded edges, squared edges, or edges with other configurations. The circumferential groove may have other shapes, such as a V-shape or a U-shape. The circumferential extension may be at an angle to the longitudinal axis other than about 90° and/or may be straight, curved, or another shape. Similarly, the radial wall may extend from the circumferential wall at an angle other than 90°, may not be parallel with the longitudinal axis, and/or may be straight, curved, or another shape. Vents may be provided in the sleeves or the interface portion to further enhance airflow into the chamber. These and other implementations are within the scope of the following claims.

What is claimed is:

1. A first electrical connector configured to be removably coupled to a second electrical connector that includes a housing and a sleeve that depends from the housing, the first electrical connector comprising:

a body having a longitudinal axis and an interface portion; and a circumferential groove formed in the interference portion, the groove being defined by a circumferential wall of the interference portion, a radial wall extending from the circumferential wall away from the longitudinal axis, and a circumferential extension extending axially from the radial wall, wherein the radial wall and the circumferential extension are configured such that:

when the first electrical connector is coupled to the second electrical connector, the circumferential extension is snugly received in the sleeve of the second connector to form an air-tight chamber between the sleeve and the interference portion, and as the first electrical connector is removed from the second electrical connector, an air flow path is defined around an end of the sleeve in a space between the circumferential extension and the sleeve to allow air to enter the chamber to inhibit flashover.

2. The first electrical connector of claim 1, wherein the sleeve is configured to buckle towards the circumferential wall as the first electrical connector is removed from the second electrical connector.

3. The first electrical connector of claim 2, wherein the sleeve is configured to buckle into the chamber as the first electrical connector is removed from the second electrical connector.

4. The first electrical connector of claim 2, wherein the chamber has a relatively large volume.

5. The first electrical connector of claim 4, wherein the chamber has a volume of approximately 0.7 cubic inches.

6. The first electrical connector of claim 1, wherein the sleeve is configured to buckle into the chamber as the first electrical connector is removed from the second electrical connector.

7. The first electrical connector of claim 1, wherein the chamber has a relatively large volume.

8. The first electrical connector of claim 7, wherein the chamber has a volume of approximately 0.7 cubic inches.

9. The first electrical connector of claim 1, further comprising an indicator configured to indicate when the first electrical connector is incompletely coupled to the second electrical connector.

10. The first electrical connector of claim 9, wherein the indicator comprises a visible space between an end of the sleeve and the circumferential extension.

11. The first electrical connector of claim 9, wherein the indicator comprises a colored region on the circumferential wall.

12. The first electrical connector of claim 9, wherein the indicator comprises a colored region on the radial wall.

13. The first electrical connector of claim 9, wherein the indicator comprises indicia on the circumferential wall.

14. The first electrical connector of claim 9, wherein the indicator comprises indicia on the radial wall.

15. The first electrical connector of claim 1, further comprising a conical projection extending from the body for being received in a conical bore in the second electrical connector.

16. The first electrical connector of claim 15, further comprising an interior bore in the conical projection for receiving a conductive probe of the first connector.

17. A method of inhibiting flashover in an electrical connector assembly, comprising:

providing a first electrical connector that includes a body having a longitudinal axis and an interference portion with a circumferential groove defined by a circumferential wall, a radial wall extending from the circumferential wall away from the longitudinal axis, and a circumferential extension extending axially from the radial wall;

coupling the first electrical connector to a second electrical connector that has a housing and a sleeve depending from the housing, such that the circumferential extension is snugly received in the sleeve of the second connector to form an air-tight chamber between the sleeve and the interface portion; and removing the first electrical connector from the second electrical connector such that an air flow path is defined around an end of the sleeve in a space between the circumferential extension and the sleeve to allow air to enter the chamber to inhibit flashover.

18. The method of claim 17, wherein the sleeve is configured to buckle towards the circumferential wall as the first electrical connector is removed from the second electrical connector.

19. The method of claim 18, wherein the sleeve is configured to buckle into the chamber as the first electrical connector is removed from the second electrical connector.

20. The method of claim 18, wherein the chamber has a relatively large volume.

21. The method of claim 20, wherein the chamber has a volume of approximately 0.7 cubic inches.

22. The method of claim 17, wherein the sleeve is configured to buckle into the chamber as the first electrical connector is removed from the second electrical connector.

23. The method of claim 17, wherein the chamber has a relatively large volume.

24. The method of claim 23, wherein the chamber has a volume of approximately 0.7 cubic inches.

25. The method of claim 17, further comprising providing an indicator configured to indicate when the first electrical connector is incompletely coupled to the second electrical connector.

26. The method of claim 25, wherein the indicator comprises a visible space between an end of the sleeve and the circumferential extension.

27. The method of claim 25, wherein the indicator comprises a colored region on the circumferential wall.

28. The method of claim 25, wherein the indicator comprises a colored region on the radial wall.

29. The method of claim 25, wherein the indicator comprises indicia on the circumferential wall.

30. The method of claim 25, wherein the indicator comprises indicia on the radial wall.

31. The method of claim 17, wherein the first connector further comprises a conical projection extending from the body for being received in a conical bore in the second electrical connector.

32. The method of claim 31, wherein the conical projection defines an interior bore in the conical projection for receiving a conductive probe of the first connector.

33. An electrical connector assembly comprising:

a first electrical connector comprising a body having a longitudinal axis, and an interference portion with a circumferential groove formed in the interface portion, the groove being defined by a circumferential wall of the interface portion, a radial wall extending from the circumferential wall away from the longitudinal axis, and a circumferential extension extending axially from the radial wall; and a second electrical connector comprising a housing and a sleeve depending from the housing, wherein the radial wall and the circumferential extension of the first electrical connector are configured such that:

when the first electrical connector is coupled to the second electrical connector, the circumferential extension is snugly received in the sleeve of the second connector to form an air-tight chamber between the sleeve and the interface portion, and as the first electrical connector is removed from the second electrical connector, an air flow path is defined around an end of the sleeve in a space between the circumferential extension and the sleeve to allow air to enter the chamber to inhibit flashover.

34. The electrical connector assembly of claim 33, wherein the sleeve of the second connector is composed of an elastomeric material.

35. The electrical connector assembly of claim 33, wherein the sleeve is configured to buckle towards the circumferential wall as the first electrical connector is removed from the second electrical connector.

36. The electrical connector assembly of claim 35, wherein the sleeve is configured to buckle into the chamber as the first electrical connector is removed from the second electrical connector.

37. The electrical connector assembly of claim 35, wherein the chamber has a relatively large volume.

38. The electrical connector assembly of claim 37, wherein the chamber has a volume of approximately 0.7 cubic inches.

39. The electrical connector assembly of claim 33, wherein the sleeve is configured to buckle into the chamber as the first electrical connector is removed from the second electrical connector.

40. The electrical connector assembly of claim 33, wherein the chamber has a relatively large volume.

41. The electrical connector assembly of claim 40, wherein the chamber has a volume of approximately 0.7 cubic inches.

42. The electrical connector assembly of claim 33, further comprising an indicator configured to indicate when the first electrical connector is incompletely coupled to the second electrical connector.

43. The electrical connector assembly of claim 42, wherein the indicator comprises a visible space between an end of the sleeve and the circumferential extension.

44. The electrical connector assembly of claim 42, wherein the indicator comprises a colored region on the circumferential wall.

45. The electrical connector assembly of claim 42, wherein the indicator comprises a colored region on the radial wall.

46. The electrical connector assembly of claim 42, wherein the indicator comprises indicia on the circumferential wall.

47. The electrical connector assembly of claim 42, wherein the indicator comprises indicia on the radial wall.

* * * * *